US008680389B2

(12) United States Patent
Yamanaka

(10) Patent No.: US 8,680,389 B2
(45) Date of Patent: Mar. 25, 2014

(54) PICKUP DEVICE AND ELECTRIC STRINGED MUSICAL INSTRUMENT USING THE PICKUP DEVICE

(75) Inventor: Koreaki Yamanaka, Jakarta (ID)

(73) Assignee: Yamaha Corporation, Hamamatsu-Shi, Shizuoka-Ken (JP)

( * ) Notice: Subject to any disclaimer, the term of this patent is extended or adjusted under 35 U.S.C. 154(b) by 231 days.

(21) Appl. No.: 13/358,741

(22) Filed: Jan. 26, 2012

(65) Prior Publication Data

US 2012/0210848 A1 Aug. 23, 2012

(30) Foreign Application Priority Data

Feb. 23, 2011 (JP) ..... 2011-036532

(51) Int. Cl.
*G10H 3/14* (2006.01)

(52) U.S. Cl.
USPC ..... 84/725; 84/723; 84/726; 84/743

(58) Field of Classification Search
None
See application file for complete search history.

(56) References Cited

U.S. PATENT DOCUMENTS

| | | | | |
|---|---|---|---|---|
| 3,236,930 | A * | 2/1966 | Fender | 84/728 |
| 4,069,732 | A | 1/1978 | Moskowitz et al. | |
| 4,854,210 | A | 8/1989 | Palazzolo | |
| 5,221,805 | A * | 6/1993 | Lace | 84/726 |
| 5,949,014 | A | 9/1999 | Rashak et al. | |
| 2001/0022129 | A1 * | 9/2001 | Damm | 84/291 |
| 2009/0183626 | A1 * | 7/2009 | Salehi | 84/726 |
| 2010/0031800 | A1 | 2/2010 | Ekstrom | |
| 2012/0210848 | A1 * | 8/2012 | Yamanaka | 84/726 |
| 2013/0239788 | A1 * | 9/2013 | Mills et al. | 84/726 |

FOREIGN PATENT DOCUMENTS

| | | |
|---|---|---|
| GB | 2387721 A | 10/2003 |
| JP | 2004-163717 A | 6/2004 |

OTHER PUBLICATIONS

European Search Report dated Jun. 5, 2012; application No. 12000792.7.

* cited by examiner

*Primary Examiner* — Marlon Fletcher
(74) *Attorney, Agent, or Firm* — Dickstein Shapiro LLP

(57) ABSTRACT

A pickup device mountable on a body of an electric stringed musical instrument and configured to convert vibrations of strings of the musical instrument into electric signals, including: at least one magnet each being disposed near one of the strings when the pickup device is mounted; a coil wound around the magnet; and a magnetic attaching member which is conductably connected to the coil and which can be magnetized, wherein the magnetic attaching member is constituted by a magnet which is magnetically attachable to an attachment member provided on a surface of the body, wherein the attachment member is conductably connected to at least one electric component provided on the body, and wherein the magnetic attaching member is configured such that an electrically conductive state can be established between the magnetic attaching member and the attachment member when the magnetic attaching member is magnetically attached to the attachment member.

13 Claims, 7 Drawing Sheets

PICKUP DEVICE AND ELECTRIC STRINGED MUSICAL INSTRUMENT USING THE PICKUP DEVICE

CROSS REFERENCE TO RELATED APPLICATION

The present application claims priority from Japanese Patent Application No. 2011-036532, which was filed on Feb. 23, 2011, the disclosure of which is herein incorporated by reference in its entirety.

BACKGROUND OF THE INVENTION

1. Field of the Invention

The present invention relates to a pickup device and an electric stringed musical instrument using the pickup device. More particularly, the present invention relates to such a pickup device which can be easily attached to and detached from a body of an electric stringed musical instrument and an electric stringed musical instrument using the pickup device.

2. Discussion of Related Art

In an electric stringed musical instrument such as an electric guitar, there has been conventionally used a pickup device capable of picking up, as electric signals, vibrations of strings of the electric stringed musical instrument. As a structure for mounting such a pickup device on a body of the electric stringed musical instrument, there has been generally known one in which the pickup device is fixed to the musical instrument using screws and ends of a coil of the pickup device are electrically connected by soldering to an electric component of the musical instrument. Further, other structures disclosed in the following Patent Literatures 1 and 2, for instance, are also known.

In the structure disclosed in the Patent Literature 1, a pickup is attached to a slide plate so as to form a pickup unit. Wires of the pickup are connected to electrically conductive plates attached to the slide plate. In a body of an electric stringed musical instrument described in the Patent Literature 1, a recess is formed in which the pickup unit is installed, and there are formed, in the inner peripheral surface of the recess, a groove into which the slide plate is slidably fitted. In the groove, tongue-like conductable connecting terminals are provided which are configured to come into pressing contact with the conductive plates. The body has a two-part dividable or foldable structure in which the body is openable so as to be placed in a folded state or closable so as to be placed in a flat state. The body is kept in the flat state via a fastening hardware or member.

When the pickup unit is replaced with another one in the Patent Literature 1, the fastening metal member is initially unfastened so that the body is opened, namely, the body is placed in the folded state. Subsequently, the slide plate is slidingly moved outward, so that the installed pickup unit is pulled out of the recess. Thereafter, the slide plate of another pickup is slidingly inserted into the groove of the recess, whereby the pickup unit is fitted in the recess for installation. Finally, the body is closed, namely, the body is placed in the flat state, and the fastening metal member is fastened such that the body is locked so as not to be opened.

A pickup disclosed in the Patent Literature 2 includes plugs connected to the coils. By inserting the plugs into respective jacks provided on a body, an electrically conductive state is established therebetween and the pickup is installed on the body.

Patent Literature 1: JP-A-2004-163717
Patent Literature 2: U.S. Pat. No. 4,854,210
Patent Literature 3: U.S. Pat. No. 5,949,014

SUMMARY OF THE INVENTION

However, the replacement of the pickup units in the Patent Literature 1 is troublesome and burdensome. Further, since the conductive plates and the connecting terminals are brought into contact with each other by the sliding movement of the pickup unit, the accuracy of contact of the conductive plates and the connecting terminals and the durability of the connecting terminals or the like tend to lower, and the structure for the sliding movement is complicated, undesirably making commercialization difficult.

In the Patent Literature 1, the pickup unit is inserted in the recess for installation. In the Patent Literature 2, the pickup is installed by inserting the plugs into the jacks. Accordingly, the relative position between the body or the strings and the pickup, or the angle therebetween is fixed, making it impossible to adjust the relative position and the angle of the pickup.

A pickup device disclosed in the Patent Literature 3 is constituted by a pair of upper and lower pickups which are connected in the vertical direction by magnetic forces of magnets wound around respective coils of the respective pickups. Further, the upper pickup is configured to be detachable from the lower pickup and is accordingly replaceable.

In the pickup device, however, the lower pickup is fixed to a body. Accordingly, as in the Patent Literatures 1 and 2 described above, the position of the pickup device as a whole cannot be adjusted. Further, it is difficult to attach and detach the lower pickup to and from the body.

The present invention has been made in view of the situations described above. It is therefore a first object of the invention to provide a pickup device which ensures simplification of a structure, easy and quick installation on a body, easy and quick replacement, and easy position adjustment. It is a second object of the invention to provide an electric stringed musical instrument using the pickup device.

The above-indicated first object of the invention may be attained according to one aspect of the invention, which provides a pickup device (27; 127; 227; 427) which is mountable on a body (21) of an electric stringed musical instrument (10; 410) and which is configured to convert vibrations of a plurality of strings (11-16) of the musical instrument into electric signals, comprising:

at least one magnet (35) each of which is disposed in the vicinity of one of the strings when the pickup device is mounted on the body;

a coil (37) wound around the at least one magnet; and a magnetic attaching member (40; 35-1) which is conductably connected to the coil and which can be magnetized, wherein the magnetic attaching member is constituted by a magnet which is magnetically attachable to an attachment member (29; 429) provided on a surface of the body and which can be magnetized, wherein the attachment member is conductably connected to at least one electric component (29-3) provided on the body, and wherein the magnetic attaching member is configured such that an electrically conductive state can be established between the magnetic attaching member and the attachment member when the magnetic attaching member is magnetically attached to the attachment member.

The above-indicated first object of the invention may be attained according to another aspect of the invention, which provides a pickup device (127) which is mountable on a body (21) of an electric stringed musical instrument (10) and which is configured to convert vibrations of a plurality of strings (11-16) of the musical instrument into electric signals, comprising:

at least one magnet (35) each of which is disposed in the vicinity of one of the strings when the pickup device is mounted on the body; and a coil (37) wound around the at least one magnet;

wherein at least one of the at least one magnet is conductably connected to the coil, wherein an attachment member (29) which is provided on a surface of the body and which can be magnetized is conductably connected to at least one electric component (29-3) provided on the body, and wherein the at least one of the at least one magnet that is connected to the coil is magnetically attachable to the attachment member, and wherein the at least one of the at least one magnet that is connected to the coil is configured such that an electrically conductive state can be established between the at least one of the at least one magnet and the attachment member when the at least one of the at least one magnet is magnetically attached to the attachment member.

The above-indicated first object of the invention may be attained according to still another aspect of the invention, which provides, a pickup device (327) which is mountable on a body (21) of an electric stringed musical instrument (10) and which is configured to convert vibrations of a plurality of strings (11-16) of the musical instrument into electric signals, comprising:

at least one magnet (35) each of which is disposed in the vicinity of one of the strings when the pickup device is mounted on the body;

a coil (37) wound around the at least one magnet; and an attachment member (329) which is conductably connected to the coil and which can be magnetized, wherein the attachment member is magnetically attachable to a magnetic attaching member (340) which is provided on the body and which can be magnetized, wherein the magnetic attaching member is conductably connected to at least one electric component (29-3) provided on the body, and wherein the magnetic attaching member is configured such that an electrically conductive state can be established between the magnetic attaching member and the attachment member when the magnetic attaching member is magnetically attached to the attachment member.

The above-indicated second object of the invention may be attained according to one aspect of the invention, which provides an electric stringed musical instrument (10; 410), comprising:

the pickup device (27; 127; 227; 427) described above; and an attachment member (29: 429) which is provided on a surface of a body (21) of the musical instrument and which is connected to at least one electric component (29-3) provided on the body, the attachment member being magnetizable.

The reference numerals in the brackets attached to respective constituent elements of the device in the above description correspond to reference numerals used in the following embodiments to identify the respective constituent elements. The reference numerals attached to each constituent element indicates a correspondence between each element and its one example, and each element is not limited to the one example.

BRIEF DESCRIPTION OF THE DRAWINGS

The above and other objects, features, advantages and technical and industrial significance of the present invention will be better understood by reading the following detailed description of embodiments of the invention and modifications thereof, when considered in connection with the accompanying drawings, in which.

DETAILED DESCRIPTION OF THE EMBODIMENTS

There will be hereinafter explained embodiments of the present invention with reference to the drawings. Unless otherwise specified, in the following explanation, terms "left" and "right" are used to refer to a left side and a right side in FIGS. 1-10 while terms "up" and "down" are used to refer to an upper side and a lower side in FIGS. 3, 5, 7, and 9. Further, terms "front" and "rear" are used to refer to an upper side and a lower side in FIGS. 1 and 10.

First Embodiment

Figure 1:
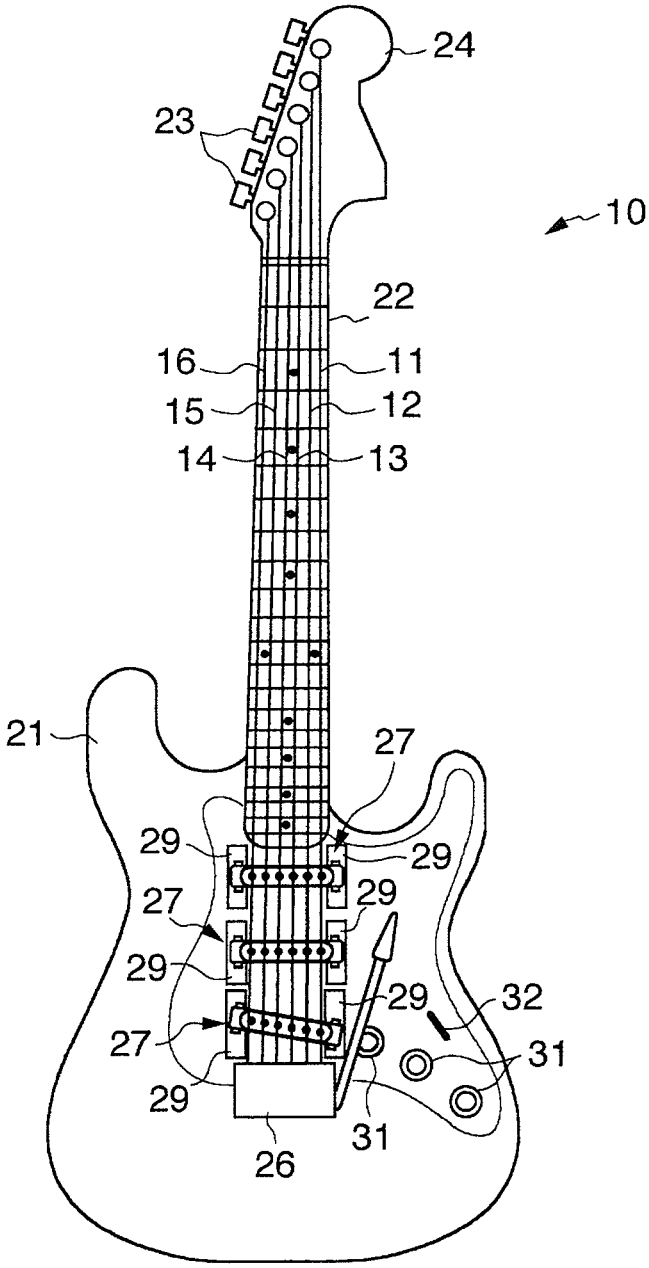
FIG. 1 is a schematic front view of an electric stringed musical instrument in a first embodiment of the invention.
Figure 2:
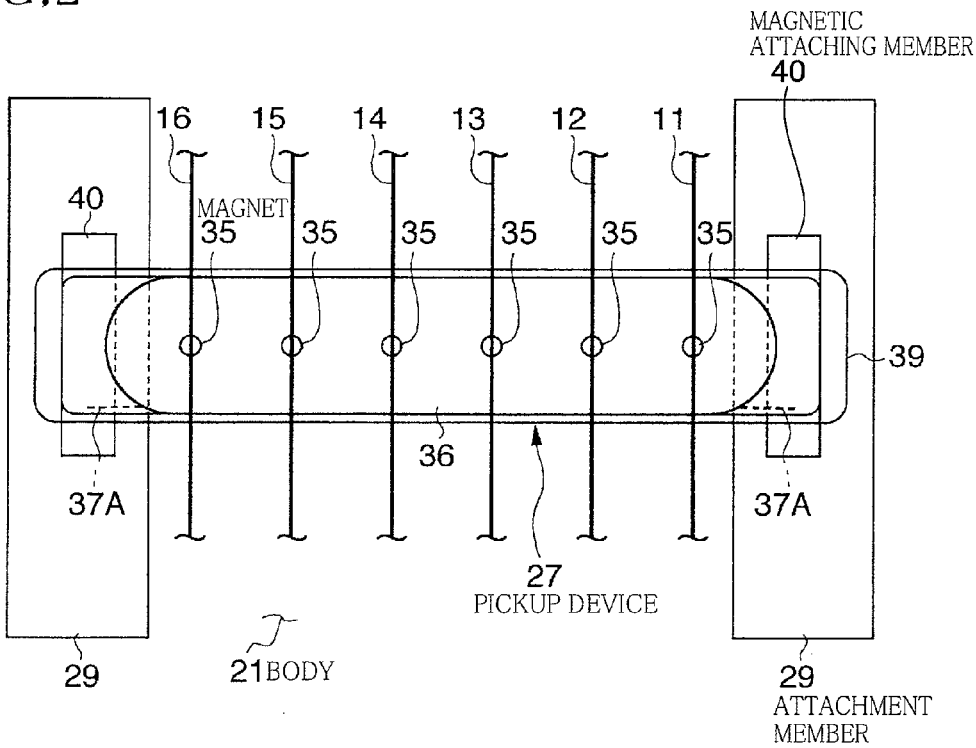
FIG. 2 is an enlarged view showing a pickup device in FIG. 1 and its periphery.
Figure 3:
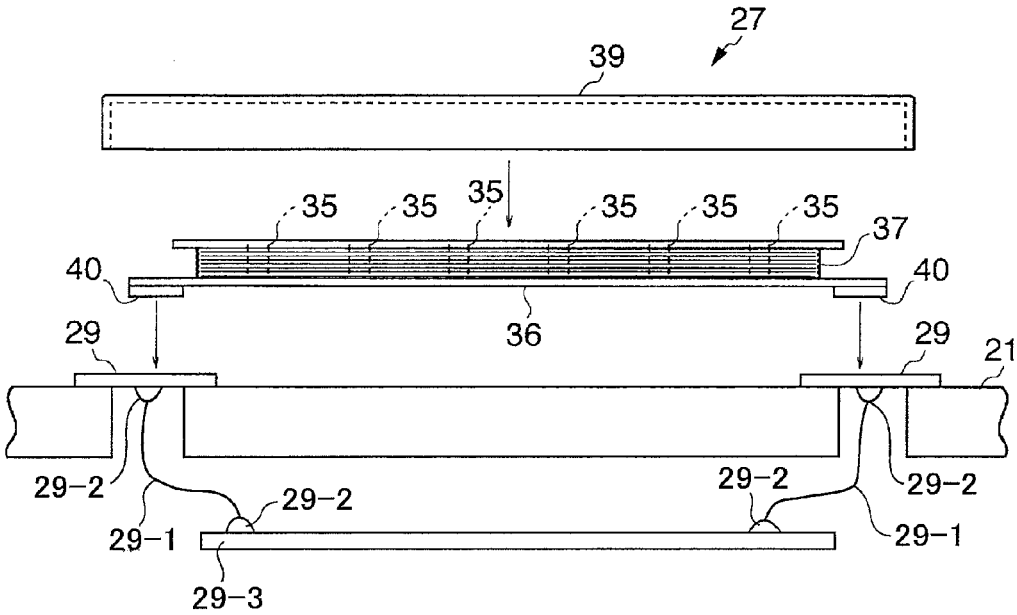
FIG. 3 is a view of the pickup device of FIG. 2 when viewed from a lateral side.

An electric stringed musical instrument 10 according to a first embodiment shown in FIGS. 1-3 is constituted as an electric guitar having first through sixth strings 11-16 arranged in a left-right direction. The electric stringed musical instrument 10 has: a body 21; a neck 22 connected to the body 21; a head 24 which supports, at a leading end of the neck 22, one of opposite ends of each of the strings 11-16 via a corresponding one of pegs 23; a bridge 26 which is disposed on a major surface (upper surface) of the body 21 and which supports the other ends of each of the strings 11-16: and three pickup devices 27 detachably disposed on the major surface of the body 21. The six strings 11-16 extend in a front-rear direction perpendicular to the left-right direction in which the six strings are arranged. The direction in which the strings 11-16 extend will be hereinafter referred to as an "extension direction of the strings 11-16" where appropriate.

At the positions on the major surface of the body 21 where the three pickup devices 27 are respectively disposed, plate-like attachment members 29 are provided. More specifically, the attachment members 29 are provided on the right side of the first string 11 and the left side of the sixth string 16 so as to sandwich the six strings 11-16 in the left-right direction, such that an underside of each of magnetic attaching members 40 (that will be described) disposed at a left-side portion and a right-side portion of each pickup device 27 comes into a surface contact with au upper surface of a corresponding one of the attachment members 29. Each attachment member 29 is formed of a plate-like member such as a magnetizable metal plate, for instance, and has a planar shape having larger dimensions in both of the left-right direction and the front-rear direction than the magnetic attaching member 40. Further, the planar shape of each attachment member 29 is a rectangular shape whose longitudinal direction coincides with the front-rear direction and in which the dimension in the front-rear direction is larger than the dimension in the left-right direction. The attachment members 29 are disposed such that two attachment members 29 are disposed as a pair at one and the other of two positions on the major surface of the body 21, so as to sandwich the six strings 11-16 in the left-right direction. Three pairs of attachment members 29 are provided along the extension direction of the six strings 11-16. Each attachment member 29 is formed of a material having good electrical conductivity capable of functioning as a metal terminal with respect to the pickup device 27. The attachment members 29 are connected to an electrical component such as a volume terminal (not shown), a jack terminal (not shown), and a preamplifier circuit board 29-3, via wiring structures such as lead wires 29-1 and solders 29-2.

On the major surface of the body 21, there are provided volume knobs 31 and a selector 32. By operating the selector 32, it is possible to select any one of the three pickup devices 27 to be used. A pair of magnetic attaching members 40 in each of the three pickup devices 27 is detachably attached to a corresponding one of the three pairs of attachment members 29.

Each pickup device 27 includes: cylindrical magnets 35 disposed in the vicinity of and right below the corresponding strings 11-16; a bobbin 36 which holds the magnets 35 in an upright state; a coil 37 wound around an outer surface of the bobbin 36 outwardly of the magnets 35; a box-like cover 39 which covers the bobbin 36 from above; and the two magnetic attaching members 40 disposed at one and the other of left-side and right-side portions on the underside of the bobbin 36. Each pickup device 27 is configured to detect vibrations of the strings 11-16 as electromagnetic induction and to convert the detected vibrations into electric signals, so as to output the electric signals therefrom. Each magnet 35 may be constituted by a permanent magnet or may be provided by attaching a magnet under the bobbin 36 so as to have a magnetic force. In the present embodiment, the bobbin 36 is formed of ABS resin, vulcanized fiber or the like, and the cover 39 is formed by transparent acrylic or the like. As needed, the pickup device 27 may be used without using the cover 39.

Each magnetic attaching member 40 is a plate-like member formed of a magnetizable material such as a permanent magnet or a magnetic material and is bonded to the lower surface of the bobbin 36 using an adhesive or a double-sided adhesive tape. Accordingly, the lower surface of each magnetic attaching member 40 is magnetically attachable, by surface contact, to the upper surface of a corresponding one of the attachment members 29. By surface contact of the magnetic attaching members 40 and the attachment members 29, the pickup device 27 can be mounted on the body 21 and can be positioned relative to the body 21. In this state, by removing the pickup device 27 from the body 21 with an intentional external force, the magnetic attachment between the magnetic attaching members 40 and the attachment members 29 are cancelled, whereby the pickup device 27 can be detached from the body 21. Further, by applying the intentional external force while keeping the magnetically attached state of the magnetic attaching members 40 to the attachment members 29, it is possible to slidingly move the pickup device 27 in the front-rear direction or in the left-right direction, or it is possible to turn the pickup device 27 so as to rotate clockwise or counterclockwise in front view.

Each magnetic attaching member 40 is formed of a highly conductive magnet such as an alnico magnet (i.e., a magnet formed of an alloy of aluminum, nickel, and cobalt) or a samarium-cobalt magnet. Each magnetic attaching member 40 is conductably connected to a corresponding one of ends 37A of the coil 37 through a solder or the like, so as to function as a terminal. Accordingly, the magnetic attaching members 40 are simply brought into contact with and magnetically attach to the attachment members 29, whereby an electrically conductive state can be established therebetween. Further, concurrently with mounting of the pickup device 27, the pickup device 27 can be electrically connected to the electrical component.

In the present embodiment, therefore, owing to the simple structures of the attachment members 29 and the magnetic attaching members 40, each pickup device 27 can easily and quickly attach and detach to and from the body 21, and the electrically conductive state can be established between the attachment members 29 and the magnetic attaching members 40 at the same time when the pickup device 27 is mounted. Accordingly, by preparing other pickup devices 27 with different tones, the pickup device 27 can be easily replaced without much difficulty with another one even in the midst of performance, thereby enhancing a degree of freedom in performance. Further, it is possible to adjust the position of each pickup device 27 in the extension direction of the strings 11-16 or to dispose each pickup device 27 so as to be inclined with respect to the extension direction of the strings 11-16, while keeping the contact state of the attachment members 29 and the magnetic attaching members 40. Hence, it is possible to change the sound quality or the sound volume by the position change while keeping electric connection of the pickup device 27, thereby also enhancing the freedom degree of performance. Moreover, the contact between the attachment members 29 and the magnetic attaching members 40 can be maintained by the magnetic force, enabling improvement in the accuracy of contact and the durability of the attachment members 29 and the magnetic attaching members 40.

In the pickup device 27 according to the present embodiment, since the magnetic attaching members 40 are magnetically attachable to and electrically conductive with respect to the corresponding attachment members 29, the pickup device 27 can be removed by applying an intentional external force for detachment. Where the pickup device 27 is mounted on the body 21, the magnetic attaching members 40 are simply brought into contact with or moved toward the attachment members 29, enabling simple and quick replacement of the pickup device 27 with another one. Accordingly, the replacement of the pickup device 27 can be conducted not only in a state in which the strings 11-16 are stretched, but also during performance. By preparing a plurality of pickup devices 27 having different sizes of the magnets 35, different numbers of turns of the coil 37, etc., performance is easily customized and various needs by the player can be satisfied.

Further, by simply moving the pickup device 27 along the surfaces of the plate-like shaped attachment members 29, it is possible to adjust the position and the angle of the pickup device 27 relative to the body 21 while keeping the electrically conductive state. Therefore, the sound quality can be changed by changing the position of the pickup device 27, or the pickup device 27 can be used at the position or the angle adjusted so as to suit preferences of the player, resulting in improvement in performance characteristic.

Moreover, the attachment members 29 on which the pickup device 27 is mounted have the plate-like shape, leading to simplification of the structure and improvement in the durability. Further, the attachment members 29 and the magnetic attaching members 40 can be held in good contact owing to the magnetic force

Second Embodiment

Figure 4:
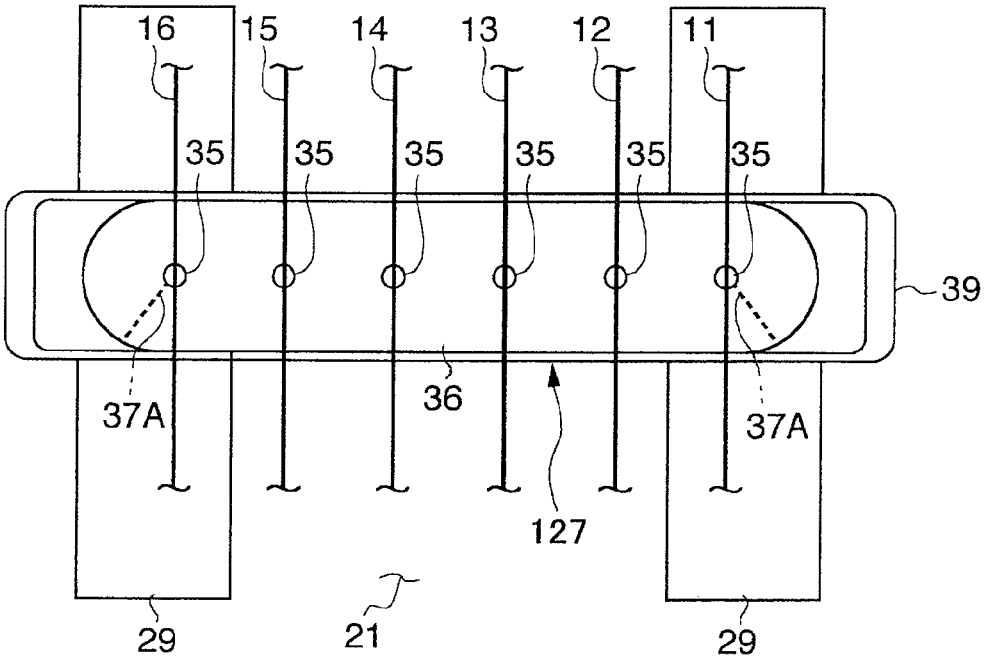
FIG. 4 is an enlarged view showing a pickup device according to a second embodiment of the invention and its periphery.
Figure 5:
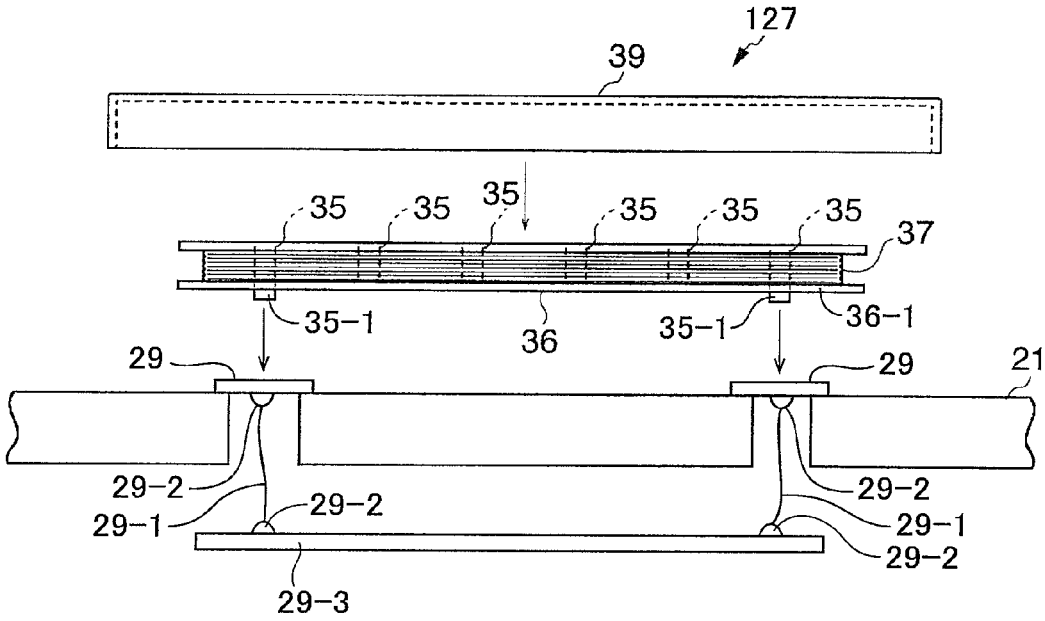
FIG. 5 is a view of the pickup device of FIG. 4 when viewed from a lateral side.

Next, there will be explained a pickup device 127 according to a second embodiment of the present invention with reference to FIGS. 4 and 5. In the second embodiment, the same reference numerals as used in the illustrated first embodiment are used to identify the corresponding components, and a detailed explanation of which is dispensed with.

In the pickup device 127 according to the second embodiment shown in FIG. 4, one end 37A of the coil 37 is conductably connected to the magnet 35 located right below the first string 11 while the other end 37A of the coil 37 is conductably connected to the magnet 35 located right below the sixth string 16. Each magnet 35 is constituted by a permanent magnet similar to that of the magnetic attaching member 40 in the illustrated first embodiment. Each of the magnet 35 located right below the first string 11 and the magnet 35 located right below the sixth string 16 has a contact portion 35-1 which passes through a lower hat portion 36-1 of the bobbin 36, so as to extend downwardly of the lower surface of the bobbin 36. The contact portions 35-1 are configured to come into contact with the attachment members 29. Further, the attachment members 29 are provided at respective positions including regions respectively right below the first string 11 and the sixth string 16. When the pickup device 127 of the second embodiment is mounted on the stringed musical instrument 10, the lower surfaces of the contact portions 35-1 come into surface contact with the corresponding upper surfaces of the respective attachment members 29, whereby the magnets 35 connected to the coil 37 magnetically attach to the respective attachment members 29. Thus, the pickup device 127 is mounted on the body 21 and at the same time, an electrically conductive state can be established between the magnets 35 connected to the coil 37 and the attachment members 29, so that the pickup device 127 can be electrically connected to the electric component.

In the pickup device 127 of the second embodiment, the magnetic attaching members 40 used in the pickup device 27 of the first embodiment can be eliminated, simplifying the structure of the pickup device 127.

While the embodiments of the present invention have been described, the present invention is not limited to the details of the embodiments.

That is, while the present invention has been described with reference to the drawings while mainly referring to particular embodiments, it is to be understood that the invention may be embodied as needed with other modifications and changes, which occur to those skilled in the art, with respect to the configuration, the position, the layout, and the like.

Accordingly, the above description that limits the disclosed configuration and the like is made for the illustrative purpose for easier understanding of the invention and does not limit the invention. Therefore, a description of components from which a part of or an entirety of limitation as to the configuration, etc., is eliminated is also included in the present invention. Some modifications will be hereinafter described.

First Modification

Figure 6:
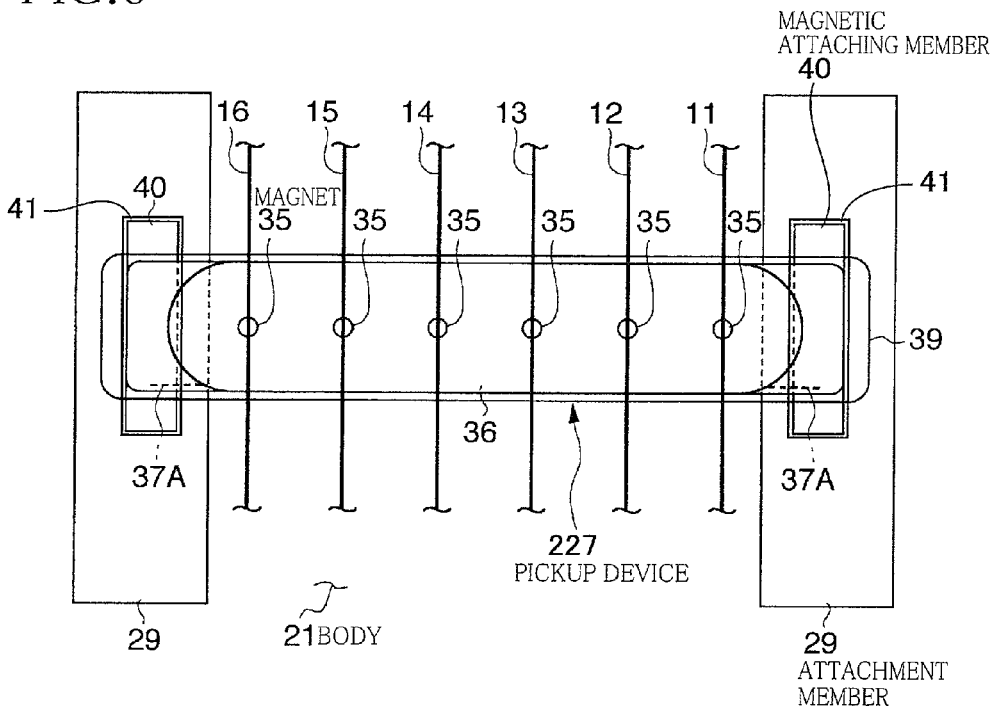
FIG. 6 is an enlarged view showing a pickup device according to a first modification of the first embodiment and its periphery.
Figure 7:
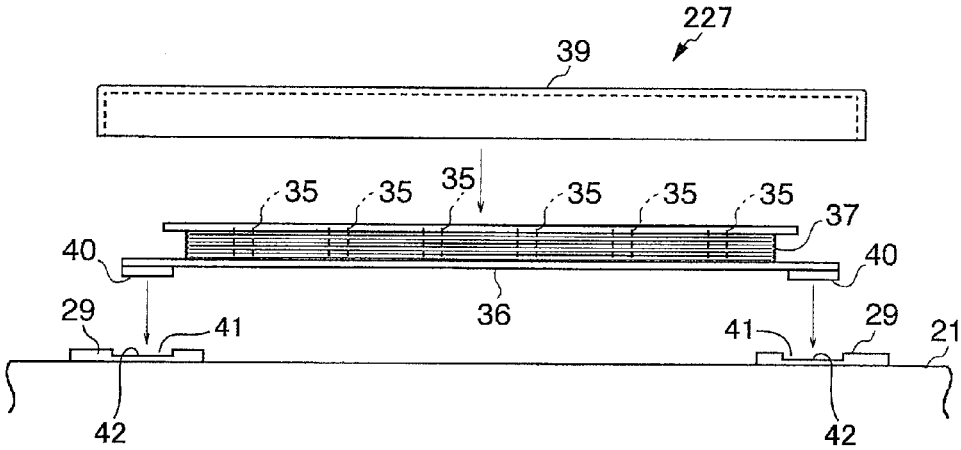
FIG. 7 is a view of the pickup device of FIG. 6 when viewed from a lateral side.

The pickup device 27 may have a positioning means configured to limit a position shift of the pickup device 27 in the left-right and the front-rear directions in a state in which the pickup device 27 is mounted on the body 21. FIGS. 6 and 7 show a pickup device 227 according to a first modification. In the pickup device 227, a guide groove 41 is formed as the positioning means, in each attachment member 29. The guide groove 41 is a recess which is concaved downward from the upper surface of the attachment member 29. The guide groove 41 has dimensions in the front-rear direction and in the left-right direction which are slightly larger than those of the magnetic attaching member 40. Further, the depth of the guide groove 41 (i.e., the dimension of the guide groove 41 in the vertical direction) is slightly smaller than the thickness of the magnetic attaching member in the vertical direction. When the pickup device 227 is attached to the attachment members 29, the magnetic attaching members 40 are inserted into the corresponding guide grooves 41, and the lower surfaces of the respective magnetic attaching members 40 are brought into surface contact with corresponding contact surfaces 42 of the guide grooves 41, each contact surface 42 defining the lower end of the corresponding guide groove 41. Thus, the magnetic attaching members 40 magnetically attach to the corresponding attachment members 29. In a state in which the magnetic attaching members 40 magnetically attach to the attachment members 29, the guide grooves 41 limit a movement of the pickup device 227 relative to the body 21 in the front-rear and the left-right directions. The arrangement prevents the relative position of the strings 11-16 and the pickup device 227 from being accidentally shifted, ensuring stable output. In the first modification, the guide groove 41 is formed in the attachment member 29. The guide groove 41 may be formed in the magnetic attaching member 40. In this instance, the attachment member 29 may be configured to have a protrusion having dimensions in the front-rear direction and in the left-right direction which are smaller than those of the guide groove 41, whereby similar advantages can be ensured. In the first modification, the guide groove 41 is configured to limit the position shift of the pickup device 227 in both of the left-right direction and the front-rear direction. The guide groove 41 may be configured to limit the position shift in only one of the left-right direction and the front-rear direction.

Second Modification

Figure 8:
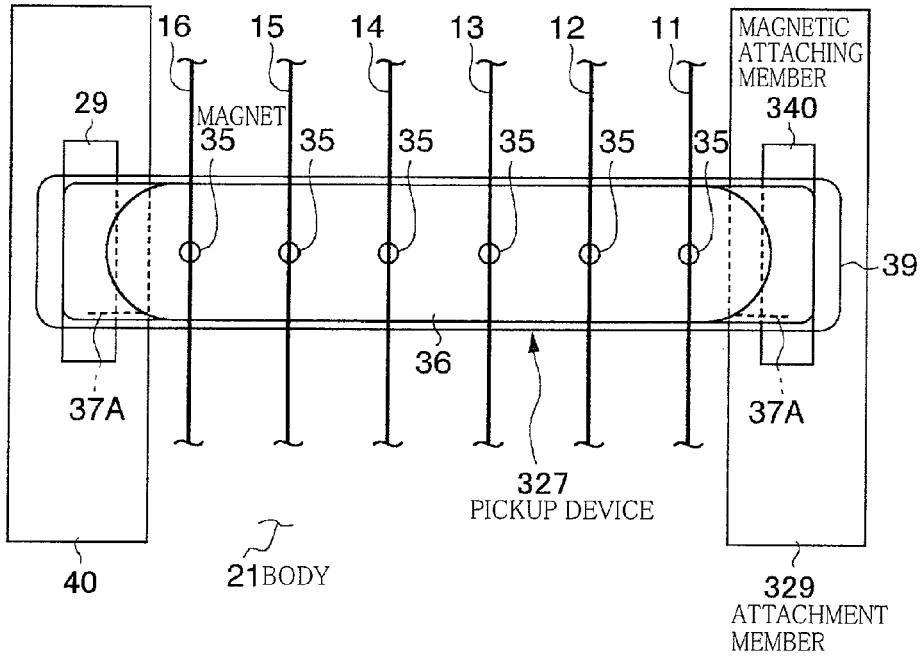
FIG. 8 is an enlarged view showing a pickup device according to a second modification of the first embodiment and its periphery.
Figure 9:
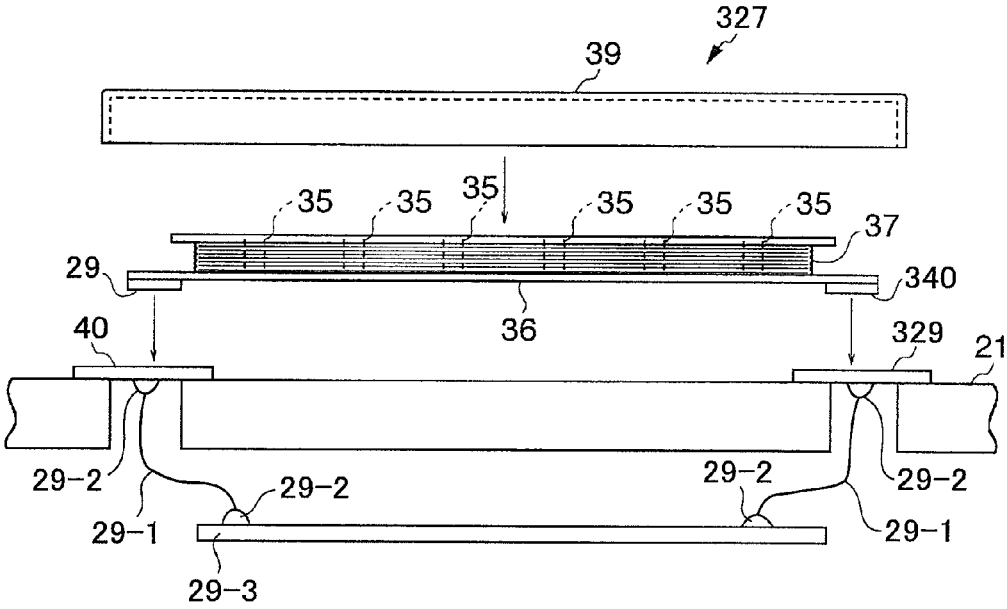
FIG. 9 is a view of the pickup device of FIG. 8 when viewed from a lateral side.

FIGS. 8 and 9 show a pickup device 327 according to a second modification. In the pickup device 327, the attachment member 29 used in the pickup device 27 of the first embodiment is constituted as a magnetic attaching member 340 formed of a material, such as a permanent magnet, capable of exhibiting the magnetic force while the magnetic attaching member 40 used in the pickup device 27 of the first embodiment is constituted as an attachment member 329 formed of a material, such as a metal plate, capable of being magnetized though not exhibiting the magnetic force. In the arrangement, the attachment members 329 provided on the major surface of the body 21 and the magnetic attaching members 340 of the pickup device 327 are configured to magnetically attach to each other.

Third Modification

Figure 10:
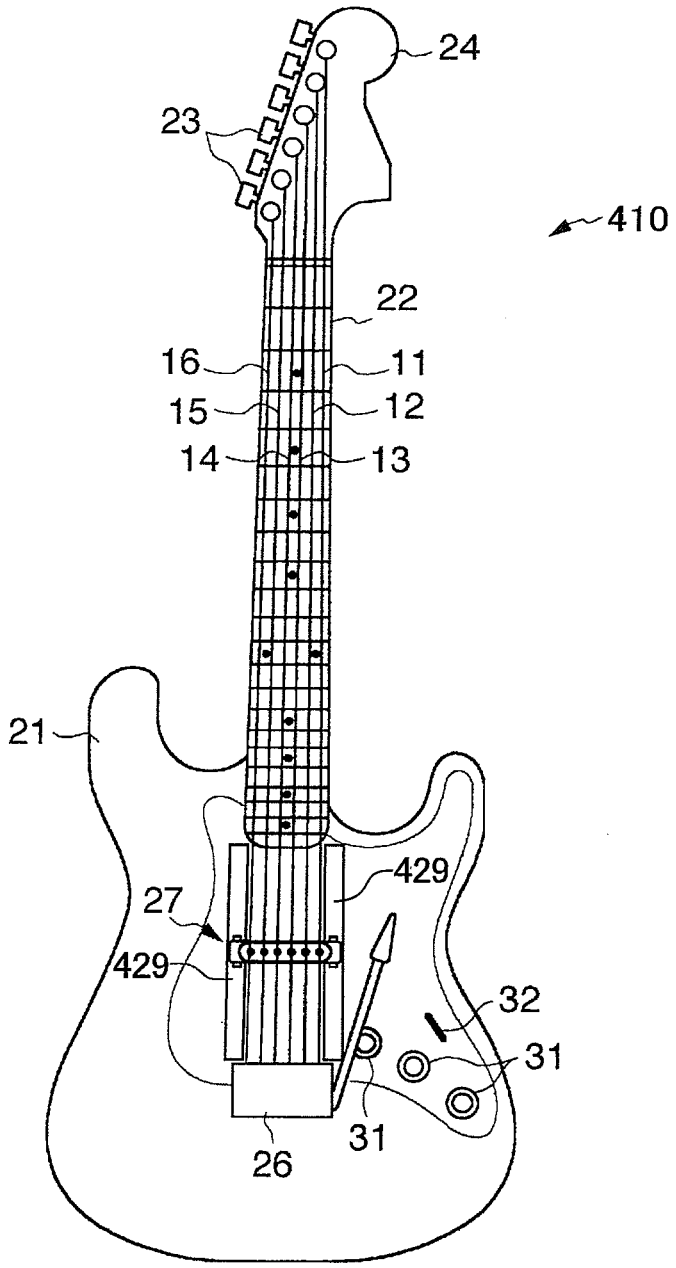
FIG. 10 is a schematic front view of an electric stringed musical instrument in a third modification of the first embodiment of the invention.

FIG. 10 shows an electric stringed musical instrument 410 according to a third modification. In the electric stringed musical instrument 410, two attachment members 429 are disposed as a pair on one and the other of the front and left sides of the six strings 11-16 so as to sandwich the strings 16 therebetween in the direction of arrangement of the strings

11-16. The pair of attachment members 429 is provided on the major surface of the body 21 along the extension direction of the strings 11-16, such that only one pickup device 27 can be installed. In the electric stringed musical instrument 410, the attachment members 429 extend in the direction of extension of the six strings 11-16, so that it is possible to freely change the position of the pickup device 27 in the front-rear direction, relative to the six strings 11-16. Therefore, the quality and the volume of the sound to be generated by the electric stringed musical instrument 410 can be changed, thereby enhancing the freedom degree of performance.

Other Modifications

The magnets 35 are not limited to those described above. There may be employed a single bar-like magnet which extends across the six strings 11-16 below the same 11-16.

The present invention may be applicable to other electric stringed musical instruments such as an electric base guitar.

What is claimed is:

1. A pickup device which is mountable on a body of an electric stringed musical instrument and which is configured to convert vibrations of a plurality of strings of the musical instrument into electric signals, comprising:

at least one magnet each of which is disposed in the vicinity of one of the strings when the pickup device is mounted on the body;

a coil wound around the at least one magnet; and a magnetic attaching member which is conductably connected to the coil and which can be magnetized, wherein the magnetic attaching member is constituted by a magnet which is magnetically attachable to an attachment member provided on a surface of the body and which can be magnetized, wherein the attachment member is conductably connected to at least one electric component provided on the body, and wherein the magnetic attaching member is configured such that an electrically conductive state can be established between the magnetic attaching member and the attachment member when the magnetic attaching member is magnetically attached to the attachment member.

2. The pickup device according to claim 1, wherein the attachment member has a plate-like shape having a planar surface that is substantially parallel to a surface of the body.

3. The pickup device according to claim 2, wherein a longitudinal direction of the planar surface of the attachment member is substantially parallel to a direction in which the plurality of strings extend.

4. The pickup device according to claim 1, wherein two attachment members, each as the attachment member, are disposed at one and the other of two positions on a surface of the body, so as to sandwich the plurality of strings in a direction in which the strings are arranged.

5. The pickup device according to claim 1, comprising: a plurality of magnets each as the at least one magnet; and two magnetic attaching members, each as the magnetic attaching member, which are disposed at one and the other of two positions so as to sandwich the plurality of magnets in a direction which the plurality of magnets are arranged.

6. The pickup device according to claim 2, wherein the magnetic attaching member has a plate-like shape, and wherein the magnetic attaching member magnetically attaches to the attachment member by a surface contact of one plane of the magnetic attaching member with the planar surface of the attachment member.

7. The pickup device according to claim 6, wherein the planar surface of the magnetic attaching member has a rectangular shape, and wherein the magnetic attaching member is mounted on the surface of the body by magnetically attaching to the attachment member, such that a longitudinal direction of the planar surface of the magnetic attaching member is substantially parallel to a longitudinal direction of the planar surface of the attachment member.

8. The pickup device according to claim 1, wherein the attachment member has a guide groove into which the magnetic attaching member is inserted.

9. An electric stringed musical instrument, comprising:

the pickup device defined in claim 1; and an attachment member which is provided on a surface of a body of the musical instrument and which is connected to at least one electric component provided on the body, the attachment member being magnetizable.

10. The electric stringed musical instrument according to claim 9, comprising:

two attachment members, each as the attachment member, which are disposed as a pair at one and the other of two positions so as to sandwich the plurality of strings in a direction in which the strings are arranged, the pair of attachment members being provided in a plural number along a direction in which the strings extend; and a plurality of pickup devices, each as the pickup device, each of which includes: a plurality of magnets each as the at least one magnet; and two magnetic attaching members, each as the magnetic attaching member, which are disposed as a pair at one and the other of two positions so as to sandwich the plurality of magnets in a direction in which the magnets are arranged.

11. The electric stringed musical instrument according to claim 9, comprising:

two attachment members, each as the attachment member, are disposed as a pair at one and the other of two positions so as to sandwich the plurality of strings in a direction in which the strings are arranged, the pair of attachment members being disposed along a direction in which the strings extend; and only one pickup device as the pickup device which includes: a plurality of magnets, each as the at least one magnet; and two magnetic attaching members, each as the magnetic attaching member, which are disposed as a pair at one and the other of two positions so as to sandwich the plurality of magnets in a direction in which the magnets are arranged.

12. A pickup device which is mountable on a body of an electric stringed musical instrument and which is configured to convert vibrations of a plurality of strings of the musical instrument into electric signals, comprising:

at least one magnet each of which is disposed in the vicinity of one of the strings when the pickup device is mounted on the body; and a coil wound around the at least one magnet;

wherein at least one of the at least one magnet is conductably connected to the coil, wherein an attachment member which is provided on a surface of the body and which can be magnetized is conductably connected to at least one electric component provided on the body, and wherein the at least one of the at least one magnet that is connected to the coil is magnetically attachable to the attachment member, and wherein the at least one of the at least one magnet that is connected to the coil is configured such that an electrically conductive state can be established between the at least one of the at least one magnet and the attachment member when the at least one of the at least one magnet is magnetically attached to the attachment member.

13. A pickup device which is mountable on a body of an electric stringed musical instrument and which is configured to convert vibrations of a plurality of strings of the musical instrument into electric signals, comprising:

at least one magnet each of which is disposed in the vicinity of one of the strings when the pickup device is mounted on the body;

a coil wound around the at least one magnet; and an attachment member which is conductably connected to the coil and which can be magnetized, wherein the attachment member is magnetically attachable to a magnetic attaching member which is provided on the body and which can be magnetized, wherein the magnetic attaching member is conductably connected to at least one electric component provided on the body, and wherein the magnetic attaching member is configured such that an electrically conductive state can be established between the magnetic attaching member and the attachment member when the magnetic attaching member is magnetically attached to the attachment member.

* * * * *